US007252032B2

(12) United States Patent
Scheffel et al.

(10) Patent No.: US 7,252,032 B2
(45) Date of Patent: Aug. 7, 2007

(54) FLUID ACTUATOR

(75) Inventors: Gary Scheffel, Streetsboro, OH (US); Jared S. Timko, Leroy Township, OH (US)

(73) Assignee: Swagelok Company, Solon, OH (US)

( * ) Notice: Subject to any disclaimer, the term of this patent is extended or adjusted under 35 U.S.C. 154(b) by 4 days.

(21) Appl. No.: 11/143,411

(22) Filed: Jun. 1, 2005

(65) Prior Publication Data

US 2005/0265868 A1 Dec. 1, 2005

Related U.S. Application Data

(60) Provisional application No. 60/575,998, filed on Jun. 1, 2004.

(51) Int. Cl.
*F16K 31/16* (2006.01)
*F17C 13/04* (2006.01)

(52) U.S. Cl. ..... 92/146; 92/151; 251/61.5

(58) Field of Classification Search ..... 92/62, 92/110, 146, 151, 169.1; 251/61.2, 61.5
See application file for complete search history.

(56) References Cited

U.S. PATENT DOCUMENTS 4,596,267 A * 6/1986 Tosseghini ..... 92/151
5,007,328 A * 4/1991 Otteman ..... 92/151
5,375,994 A 12/1994 Friderich et al.
5,762,086 A 6/1998 Ollivier
5,906,353 A * 5/1999 Someya et al. ..... 251/58
6,244,563 B1 * 6/2001 Ejiri ..... 92/151
6,357,339 B1 * 3/2002 Ejiri ..... 92/150
2003/0020035 A1 1/2003 Kremer

FOREIGN PATENT DOCUMENTS

| | | |
|---|---|---|
| EP | 512 674 | 11/1992 |
| EP | 1 154 182 | 11/2001 |
| FR | 1358512 | 4/1964 |
| JP | 08 170755 | 7/1996 |

OTHER PUBLICATIONS

International Search Report from PCT/US04/043605.

* cited by examiner

*Primary Examiner*—Thomas E. Lazo
(74) *Attorney, Agent, or Firm*—Calfee, Halter & Griswold LLP

(57) ABSTRACT

A fluid actuator configured for achieving extended cycle life and reduced overall actuator height. The actuator may include a nesting arrangement between portions of the actuator to reduce overall height and provide stability. The actuator may also join movable members and include a guidance mechanism to avoid undesired contact between actuator portions.

26 Claims, 6 Drawing Sheets

FLUID ACTUATOR

RELATED APPLICATIONS

This application claims the benefit of U.S. provisional patent application Ser. No. 60/575,998 for DEEP PISTON AIR ACTUATOR filed Jun. 1, 2004, the entire disclosure of which is fully incorporated herein by reference.

BACKGROUND

Actuators are used to control the operation of many valves and other fluid components, whether liquid, gas or a combination thereof. The actuator may be of any number of different designs including pneumatic, hydraulic, electric and so on. Piston type actuators use pressurized fluid, such as air, to move pistons in order to open and/or close the fluid component. Actuators may use multiple pistons to allow for additional surface area for the pressurized fluid to act upon, thereby increasing the force output of the actuator. Using multiple pistons, however, typically increases the overall height of the actuator, which may preclude use of the actuator in certain applications.

Known actuator designs are acceptable for many applications, though they tend to have a relatively limited cycle life. With faster cycling valves, such as an ALD (Atomic Layer Deposition) valve, the standard valve life may be reduced to only weeks. Recent efforts to increase the diaphragm cycle life on these type of valves have resulted in the actuator being the limiting factor for cycle life of the actuator/valve assembly. This is particularly pronounced when the actuator is subjected to very high cycles such as in the tens of millions. Such high cycle specifications are becoming more common in industries such as semiconductor processing, for example. The intricate processes for making semiconductor devices necessitates very high cycle lives.

Actuators that utilize multiple pistons are also susceptible to limited cycle life. For known multi-piston actuator designs, a common end of cycle life limitation results from the top piston cocking (or tilting) due to uneven spring force. The piston cocking results in metal-to-metal contact where the top piston engages a cap or a housing and forms a sliding seal. The galling action resulting from the metal-to-metal contact may produce metal chips and rough surfaces, which wear the seal causing leakage or stalling of the actuator.

SUMMARY

The invention relates to fluid actuators such as may be used, for example, with diaphragm valves or other valves and components that use linear displacement of a movable actuator member to actuate the component. More particularly the invention relates to an actuator concept that significantly increases the cycle life of the actuator, as well as the cycle life for an actuator/valve assembly. The invention also relates to an actuator that is reduced in height when compared to similar, prior known designs.

One aspect of the present invention is a fluid actuator with structural features, such as joined movable members, which significantly increase cycle life of the actuator. In one embodiment, a fluid actuator utilizes two movable actuator members which engage each other in a tight fit to reduce the tendency that the members will cock or tilt during operation or assembly. In another embodiment, a guidance mechanism is provided which selectively prevents metal-to-metal contact between a movable actuator member and a housing in areas susceptible to metal-to-metal contact caused by cocking of the components. In another embodiment, a body guidance portion is provided on the components of the housing assembly that keeps the concentricity of the assembly housing close. In another embodiment, biasing force acting on each movable actuator member is reduced, while maintaining total bias force of the actuator, by providing smaller biasing elements for each movable actuator member instead of one large biasing element.

One aspect of the present invention is a fluid actuator with structural features, such as a nested assembly, that allow for shorter overall height of the actuator. In one embodiment, the actuator maintains the required structure to ensure proper sealing during the full stroke of movable actuator members, but modifies other structural features to allow the overall height of the actuator to be reduced. For example, a housing and/or a movable actuator member can be modified to axially overlap another portion of the actuator, such as a seal surface, when the actuator is in an open or a closed position. In one embodiment, two housings are nested together with two movable actuator members nested therein. In another embodiment, a movable actuator member is provided which nests with a housing when the actuator is in an open position. In another embodiment, a movable actuator member is provided which nests with a housing when the actuator is in a closed position. In another embodiment, a movable actuator member includes a pocket that allows a biasing element or a portion of a housing to nest with the movable member. In another embodiment, a majority of the biasing element is positioned within the pocket of the movable actuator member.

One aspect of the present invention is a fluid actuator that includes first and second modular housings in a stacked arrangement. The first and second modular housings are assembled to define at least portions of first and second compartments. For example, the second modular housing may define an upper portion of the first compartment and a lower portion of the second compartment. In one embodiment, an additional compartment is added to the actuator housing assembly by each modular housing that is included.

Numerous other advantages and features of the present invention will become readily apparent from the following detailed description of the invention and the embodiments thereof, from the claims and from the accompanying drawings.

BRIEF DESCRIPTION OF THE DRAWINGS

The foregoing features of the present invention will become apparent to one skilled in the art to which the present invention relates upon consideration of the following description of the invention with reference to the accompanying drawings, in which.

DETAILED DESCRIPTION

While various aspects of the invention are described and illustrated herein as embodied in combination in the exemplary embodiments, these various aspects may be realized in many alternative embodiments, either individually or in various combinations and sub-combinations thereof. Unless expressly excluded herein all such combinations and sub-combinations are intended to be within the scope of the present invention. Still further, while various alternative embodiments as to the various aspects and features of the invention, such as alternative materials, structures, configurations, methods, devices, software, hardware, control logic and so on may be described herein, such descriptions are not intended to be a complete or exhaustive list of available alternative embodiments, whether presently known or later developed. Those skilled in the art may readily adopt one or more of the aspects, concepts or features of the invention into additional embodiments within the scope of the present invention even if such embodiments are not expressly disclosed herein. Additionally, even though some features, concepts or aspects of the invention may be described herein as being a preferred arrangement or method, such description is not intended to suggest that such feature is required or necessary unless expressly so stated. Still further, exemplary or representative values and ranges may be included to assist in understanding the present invention however, such values and ranges are not to be construed in a limiting sense and are intended to be critical values or ranges only if so expressly stated.

The present invention is directed to achieving an actuator with very high cycle life and reduced size. The invention may be used, for example, to achieve a cycle life for a two (or more) piston pneumatic actuator in excess of 25 million cycles and to fit on, for example, but not limited to, a 1-⅛" down-mount platform. The invention, however, may be used in many different configurations and is not limited to use in a down mount configuration. Further, the invention is not limited to use in industries with high cycle specifications and is furthermore not limited to its use with a valve of the design shown in the exemplary embodiments.

Figure 2:
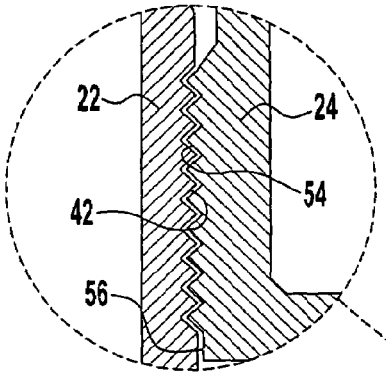
FIG. 2 is a cross sectional view of the valve body of FIG. 1, enlarged in the area of the body guidance portion.

FIG. 2 illustrates an enlarged cross-sectional view of a first embodiment of a valve and actuator assembly of the present invention in the closed position. The assembly 10 includes an actuator 12 and a valve V. The valve V is illustrated as a linear diaphragm valve and the actuator 12 is typically mounted on top of the valve V. The invention, however, is not limited to any particular connection technique between the actuator 12 and the valve V. Further, the terms upper, lower, top, bottom, upward, and downward are merely references used herein for convenience of explanation and form no structural or use limitation or reference for the invention.

The valve V is shown schematically as it forms no particular part of the present invention, other than when used in combination with an actuator in accordance with the invention. The valve illustrated is configured as a down mount component for a modular assembly such as a gas stick commonly used in semiconductor processing plants. The invention, however, may be used in a wide variety of actuator/valve configurations, modular or otherwise. The valve may include fluid passageways P1 and P2 that are in fluid communication via a valve chamber C. A diaphragm D is used to open and close the valve by selectively isolating or connecting the fluid passageways together. For example, the diaphragm may be used to seal off a port E that forms the opening of one of the passageways P1 or P2 into the valve chamber C. The diaphragm D is moved in and out of position to seal the port E by operation of an actuator stem 14 which may press against a button BT that directly contacts an upper surface (non-wetted) of the diaphragm D. The diaphragm D is securely retained in the valve body by a bonnet B and bonnet nut BN, the latter being threadably secured to the valve body A.

The fluid actuator 12, which in the illustrated embodiment is a pneumatic actuator, includes a housing assembly 16 and a plurality of movable actuator members realized in the form of a lower piston 18 and an upper piston 20. The housing assembly 16 and the movable actuator members 18, 20 may be positioned along a central axis 21 but it is not necessary that they are. It should be readily apparent that the present invention could be applied in other types of fluid actuators, such as hydraulic actuators, for example.

The housing assembly 16 may include a plurality of housing components. In the exemplary embodiment of FIG. 1, the housing assembly 16 includes a lower housing 22, an upper housing 24, and a cap 26. The upper housing 24 is assembled with the lower housing 22 such that the lower housing and the upper housing define a lower compartment 28. The cap 26 is assembled with the upper housing 24 such that the upper housing and the cap define an upper compartment 30. The housing assembly components can be made from a wide variety of materials. Examples of acceptable materials include brass, aluminum, steel, stainless steel, plastic, cast material, and sintered material. The housing assembly 16 is illustrated in the exemplary embodiment as being threaded together. The housing assembly 16, however, may be joined by other suitable means, such as a detent-type or snap-type connection.

The lower piston 18 is movably disposed in the lower compartment 28 and the upper piston 20 is movably disposed in the upper compartment 30 against the bias of a biasing element 32. The pistons 18, 20 are joined such that they move as a one-piece piston and cannot cock. The pistons can be made from a wide variety of materials. Examples of acceptable materials include brass, aluminum, steel, stainless steel, plastic, cast material, and sintered material.

It should be appreciated by one skilled in the art that while the embodiments of the actuator shown are normally extended actuators, the biasing elements and fluid inlets can be configured such as to provide a normally retracted actuator. A normally retracted actuator incorporating the features described herein is contemplated and included in this application. It should also be appreciated by one skilled in the art that the biasing member could be omitted. In this embodiment, gravity or some other external force could bias the actuator to the normal position. For example, the actuator could be a double acting actuator where fluid pressure is selectively applied to move the actuator to a variety of positions between a first and second end position.

Figure 1:
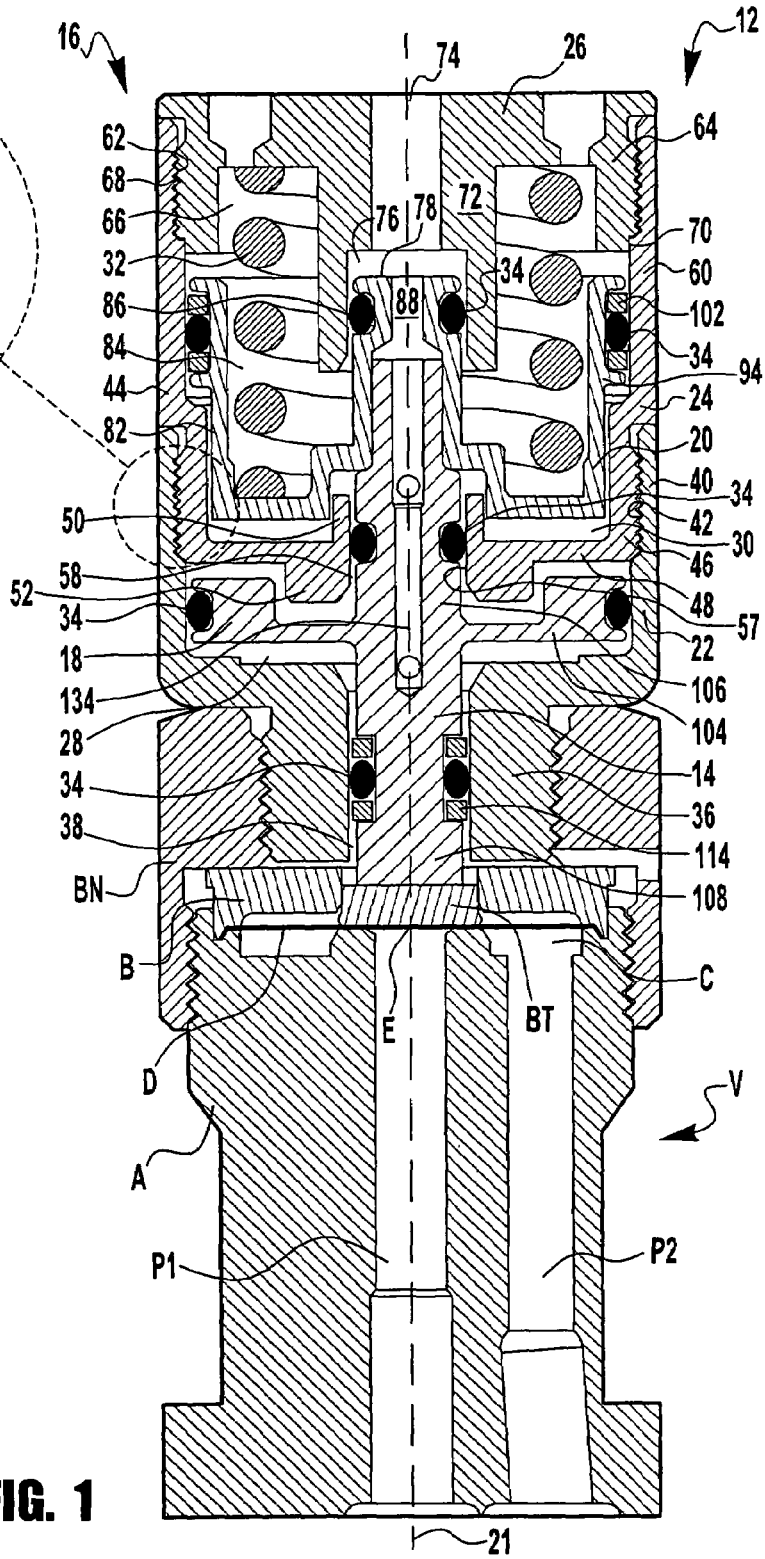
FIG. 1 is a cross-sectional view of a valve body and a fluid actuator of the present invention shown in the closed position.

To prevent fluid pressure from leaking into undesired areas which would adversely effect the operation of the actuator 12, a number of sealing elements 34 are employed between the movable actuator members 18, 20 and the housing assembly 16 to form sliding seals. In the embodiment of FIG. 1, an undesirable area, for example, would be within a compartment, but above the piston. The seals 34 may be configured in a variety of ways and constructed from a variety of material. For example, o-ring seals have been found to be suitable for most applications.

The lower housing 22 includes a threaded lower end 36 that allows the lower housing to be threadably joined to the bonnet nut BN. The lower end 36 defines a force transfer passage 38 for providing access between the lower compartment 28 and the fluid component V. The lower housing 22 extends upward in a cup-shaped configuration having a generally cylindrical sidewall 40. The sidewall 40 includes a threaded upper end portion 42 for threadably engaging the upper housing 24.

The upper housing 24 is also generally cup-shaped and includes an upper portion 44 and a lower extension 46. The lower extension 46 includes a bottom wall 48, an upward axially extending flange 50, and a downward axially extending flange 52. The bottom wall 48 and both flanges 50, 52 have an inner surface 57 that defines a force transfer passage 58 for providing access between the lower compartment 28 and the upper compartment 30. The lower extension 46 includes a threaded portion 54 for threadably engaging the lower housing 22. When engaged, the lower extension 46 nests inside the cup shaped lower housing 22. Nest or nesting means that a portion or one component or body is received within another component or body. This nesting arrangement between the lower and upper housings 22, 24, as well as the nesting arrangement between other assembled components of the actuator 12 (described below), allows for a substantial shortening of the overall actuator height while still using two pistons and also allows for a closely aligned and stable operation of two or more pistons.

The lower extension 46 also includes a body guidance portion 56 located axially adjacent to the threaded portion 54 (FIG. 2). The body guidance portion 56 is configured to tightly fit along the lower housing sidewall 40 when the upper housing 24 and lower housing 22 are threadably engaged. The tight fit between the body guidance portion 56 and the lower housing 22 guides the threaded portions 42, 54 to be on center when tight. As a result, the concentricity of the assembled housings 22, 24 is kept close. Concentricity of assembled components aids in achieving high cycle life of the actuator. Misalignment of assembled components can cause uneven forces resulting in cocking of one or both pistons 18, 20. This cocking can cause wear as a result of metal-to-metal contact, which can damage sliding seals and shorten actuator cycle life.

The upper portion 44 includes a generally cylindrical sidewall 60. The sidewall 60 includes a threaded portion 62 for threadably engaging the cap 26 or a modular housing member in a stacked relationship. Fluid actuators with modular stackable housings allow the number of pistons and piston compartments included in a fluid actuator to be adjusted based on the application and force required. For example, a two piston fluid actuator, if designed to mate with a modular stackable housing, can be modified to include three or more pistons. Additional pistons allow the actuator to exert more force on the fluid component being actuated. An example of a modular stackable fluid actuator is disclosed in International Application No. PCT/US2004/043605, the entire disclosure of which is fully incorporated herein by reference.

The cap 26 of the housing assembly 16 has a generally cylindrical configuration with a sidewall 64 defining a downward facing pocket 66. The sidewall 64 includes a threaded portion 68 for threadably engaging the upper housing 24. The sidewall 64 also includes a body guidance portion 70 located axially adjacent the threaded portion 68 for ensuring close concentricity of the cap 26 and the upper housing 24 when assembled.

The pocket 66 is adapted to receive a portion of the biasing element 32, such as a spring or spring-like member. The spring 32 is positioned between the cap 26 and the upper piston 20 to bias the upper piston downward to a first or closed position. The spring 32 may be made from a wide variety of different materials. For example, the spring 32 may be made from a stainless steel, 302 steel, 17/7 steel, or plastic. A stem 72 extending downward from the pocket 66 defines a fluid inlet 74 for pressurized fluid. The stem 72 also includes a counter bore 76 for receiving a stem 78 of the upper piston 20.

Figure 3A:
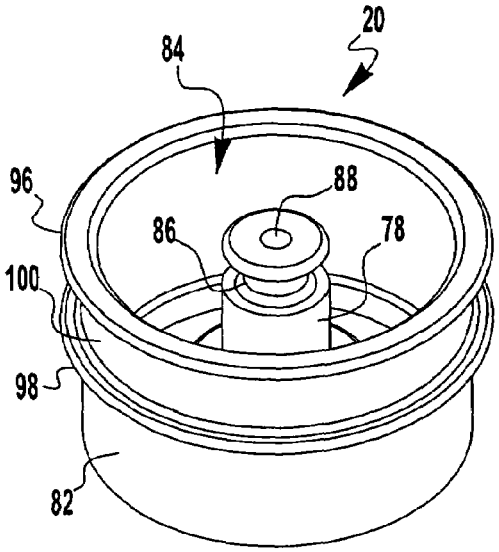
FIG. 3A-B are perspective views of the upper piston of the actuator of FIG. 1.
Figure 3B:
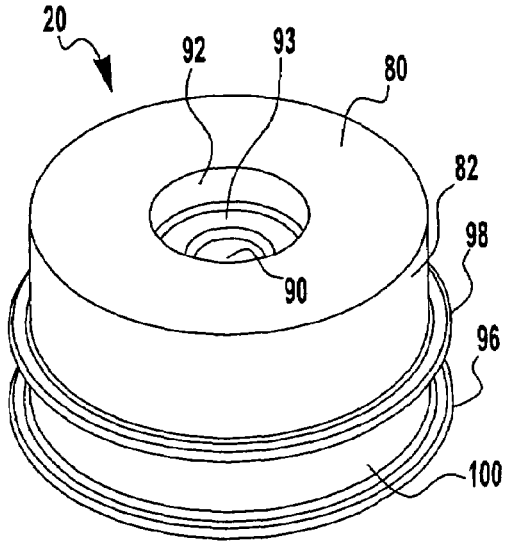

FIGS. 1 and 3A-B illustrate the upper piston 20 of the exemplary actuator 12. The upper piston 20 has a generally cylindrical, cup-shaped configuration with a bottom surface 80 for being acted on by fluid pressure. The upper piston 20 includes a generally cylindrical side wall 82 centered on the axis 21. The sidewall 82 defines a pocket 84 that receives a portion of the biasing element 32 in a nested arrangement. Nesting the spring 32 in the pocket 84 of the upper piston 20 allows the overall height of the actuator 12 to be reduced while still providing the space for a spring with sufficient coils to produce the needed bias force. Therefore, it is preferred, but not necessary, for the pocket 84 be configured to receive a majority of the biasing element 32 to optimize height reduction. The pocket 84 also provides the needed space for the upper piston 20 and lower piston 22 to join.

The axially extending stem 78 extends upward from the pocket 84 and is received into the counterbore 76 of the cap stem 72. The stem 78 includes an annular seal groove 86 containing a seal element 34, such as for example an o-ring. The o-ring 34 provides a sliding seal between the cap 26 and the upper piston 20. The stem 78 also defines a fluid passage 88 and a first counterbore 90 that connects to a second counter bore 92 by a radially extending wall portion 93.

Located at an upper portion 94 of the sidewall 82 are two radially extending flanges 96, 98 defining an annular seal groove 100 for receiving a sealing element 34 and an upper guiding mechanism 102, such as for example a pair of guide rings (discussed below).

Figure 4A:
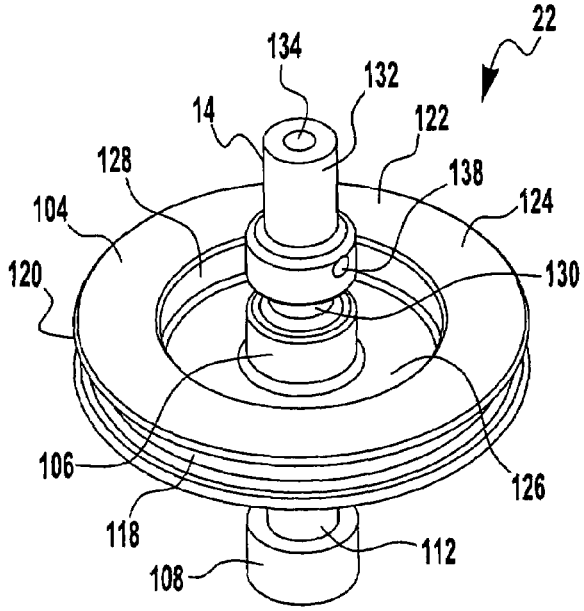
FIG. 4A-B are perspective views of the lower piston of the actuator of FIG. 1.
Figure 4B:
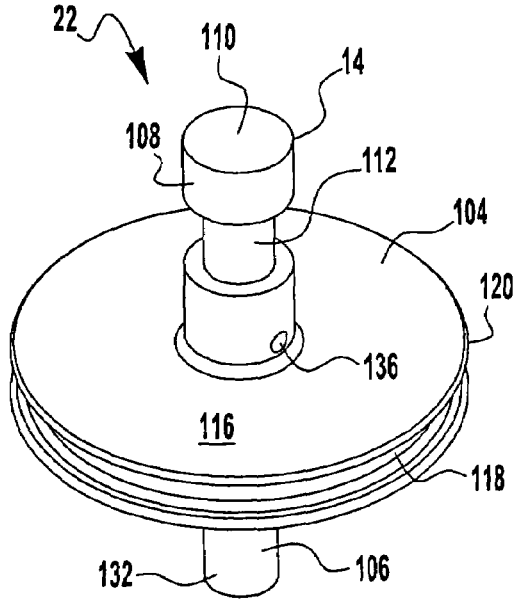

FIGS. 4A-B illustrate the lower piston 18 of the exemplary actuator 12. The lower piston 18 includes an intermediate portion 104 and the stem 14 having an upper portion 106 and a lower portion 108. The upper and lower stems 106, 108 extend from the intermediate portion 104 along the central axis 21. The lower stem 108 is a generally cylindrical elongate having a driving surface 110 for engaging the button BT. The lower stem 108 includes an annular seal groove 112 for receiving a sealing element 34 and a lower guiding mechanism 114, such as for example a pair of guide rings (discussed below). The upper and lower stem 106, 108 connect to or are integral with the intermediate portion 104.

The intermediate portion 104 is a generally disc-like configuration having a generally flat lower surface 116 for being acted on by fluid pressure. The intermediate portion 104 includes an annular seal groove 118 along an outer edge 120 for receiving a sealing element 34. The intermediate portion 104 further includes an upper surface 122. The upper surface 122 includes a first portion 124 and a pocket or recessed portion 126 connected by an axially extending surface 128.

The upper stem 106 connects to and extends from the intennediate portion 104 along the axis 21. The upper stem 106 is a generally cylindrical elongate and includes an annular seal groove 130 for receiving a sealing element 34. The upper stem 106 also includes a nose portion 132 for joining the upper piston 20.

The lower piston 22 includes a fluid passage 134 running from the nose portion 132 through the upper stem 106 and the intermediate portion 104 and into the lower stem 108. The fluid passage 134 includes a first fluid port 136 at the lower stem 108 for allowing pressurized fluid into the lower compartment 28 and a second fluid port 138 at the upper stem 106 for allowing pressurized fluid into the upper compartment 30.

Figure 5:
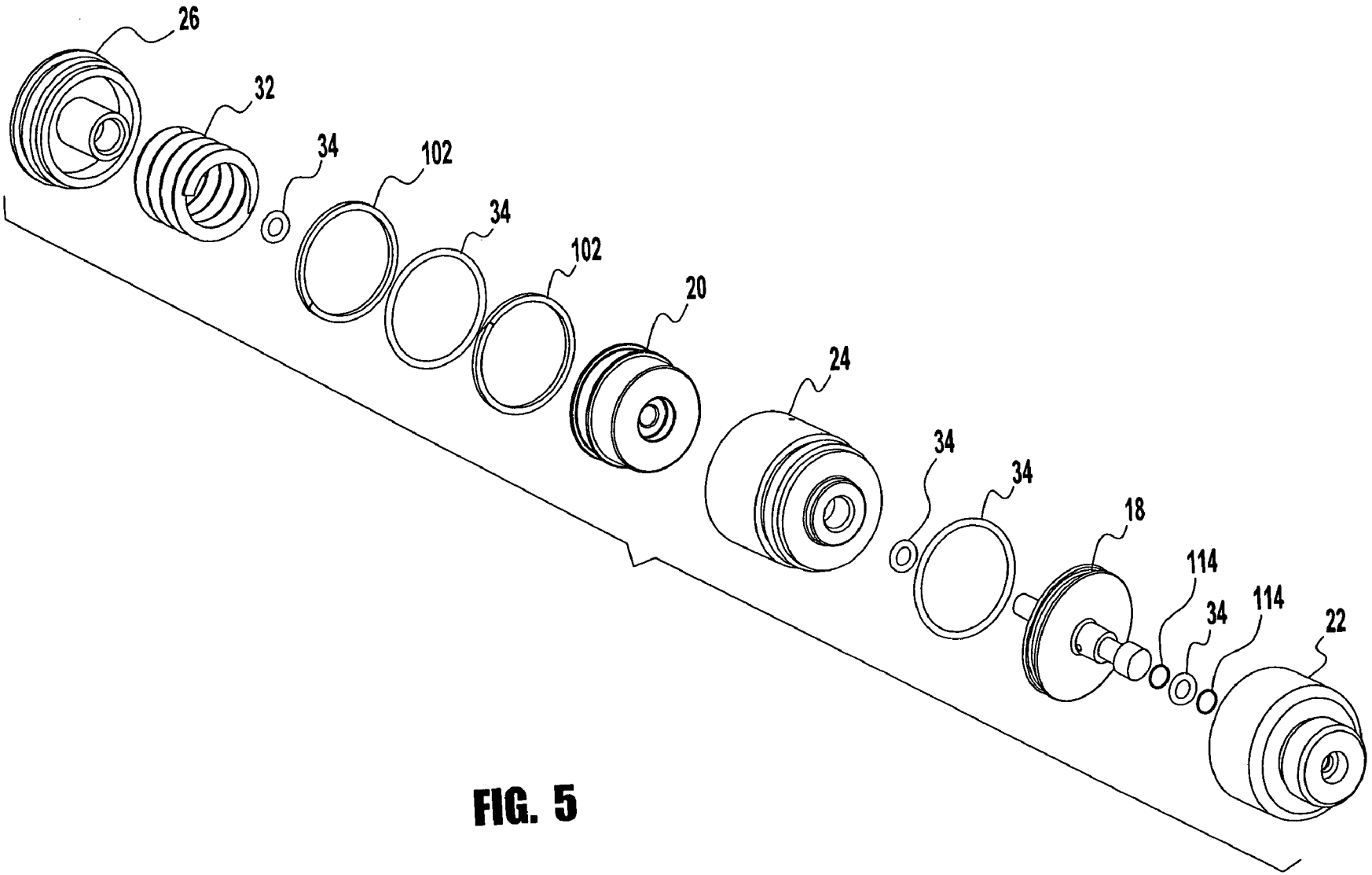
FIG. 5 is an exploded view of the fluid actuator of FIG. 1.

FIG. 1 illustrates the assembled actuator 12 in a first or closed position and FIG. 5 illustrates the components of the actuator in an exploded view. The lower and upper pistons 18, 20 are disposed within the lower and upper compartments 28, 30, respectively and are preferably, although not necessarily, closely nested within the lower and upper housings 22, 24. The nesting arrangement helps maintain good alignment, and thereby prevent cocking and wear even after many cycles of operation. The lower stem 108 is closely received by and extends through the force transfer passage 38 to engage the button BN. Thus, the lower stem 108 acts as a force transfer member during actuation of the fluid component V. The lower stem 108 also includes the sealing element 34, which provides a sliding seal between the lower piston 18 and the force transfer passage 38.

The upper stem 106 extends through the upper housing force passage 58 to engage the upper piston 20. The nose portion 132 of the lower piston 18 is closely received in the first counterbore 90 of the upper piston 20, preferably although not necessarily, by a snug or interference fit. A nominal slight press fit is desirable although not required. For example, there can be up to 0.001 inch clearance between the two pistons, but a tighter fit is preferred. This tight fit causes the pistons 18, 20 to move and act as a one piece piston giving support to each other to prevent the upper piston 20 from cocking out of alignment from uneven bias force or side load. Short or low profile pistons of prior actuator designs are more susceptible to cocking. Thus, a longer piston assembly, such as that achieved by closely joining the lower and upper pistons 18, 20, has less tendency to cock and cause wear that can lead to failure of the actuator 12.

In addition to the pistons 18,20 acting as a one-piece piston, the upper and lower guidance mechanisms 102, 114 provide further assurance that metal-to-metal contact is avoided. The guidance mechanisms 102, 114, realized in the form of guide rings, are preferably, but not necessarily, positioned on the far extremes of the one-piece piston where metal-to-metal contact between the pistons 18, 20 and housings 22, 24 is most likely. The guide rings 102, 114 reside in the seal grooves 100, 112 but extend radially outward from the pistons 18, 20. Thus, if the pistons 18, 20 cock, the guide rings 102, 114 will be positioned between the pistons and housings 22, 24 to selectively prevent metal-to-metal contact. One of ordinary skill in the art will appreciate that guidance mechanisms, such as the guide rings 102, 114, for example, can be positioned in a variety of locations between the pistons 18, 20 and housings 22, 24. The guide rings 102, 114 preferably include a low friction material with suitable wear resistance for a given application of the actuator 12. TEFLON (polytetrafluoroethylene, or PTFE) guide rings have been found suitable for most applications.

Positioning the guide rings 102, 114 on the far extremes also helps to reduce wear on the rings because the farther apart the guidance mechanisms are, the less load will be on the guide rings. In addition, where the side load caused by the biasing element 32 is greatest, at the top, large guide rings 102 are used, and where the side load is less, at the bottom, smaller guide rings 114 are used.

Figure 6:
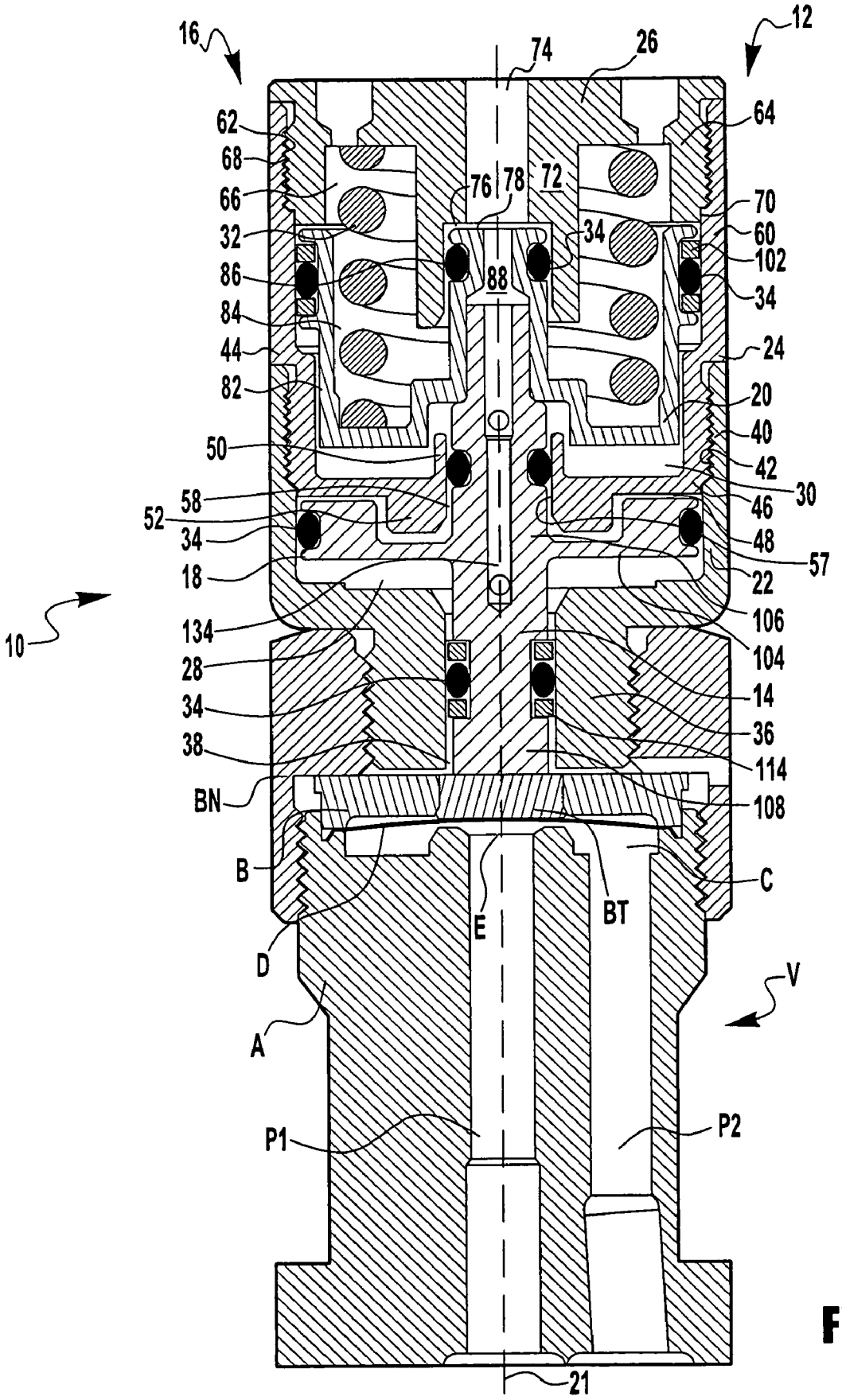
FIG. 6 is a cross-sectional view of the valve body and a fluid actuator of FIG. 1 shown in the open position.

In operation, the fluid passage 134 is in fluid communication with the fluid inlet 74 located in the cap 26. The passage 134 provides pressurized fluid via ports 136 and 138, or past the slip fit, into the lower and/or upper compartments 28, 30 below the pistons 18, 20. The pressurized fluid acts on the upper piston 20 and the lower piston 18 to drive the pistons from the first or closed position, upward against the force of the bias element 32, toward the second or open position (FIG. 6). Specifically, the fluid may act on radially extending surfaces of the pistons 18, 20, such as for example, on the bottom surface 116 of the lower piston 18 and on the bottom surface 80, the wall portion 93, and the flange 98 of the upper piston 20.

The sealing elements 34 on the pistons 18, 20 form sliding seals between the pistons and the housings 22, 24 to keep the pressurized fluid from leaking into undesirable areas and adversely affecting actuator performance. The need for the seals 34 to stay in contact with a portion of the housings 22, 24 during the stroke of the pistons 18, 20 (i.e. sufficient seal surface length of the housing is required) is one factor in dictating the overall required height of the actuator 12. Other factors include piston thickness, stroke length, threads plus guidance length, and wall thickness.

The actuator 12 maintains the required geometry to ensure proper sealing during the full stroke of pistons 18, 20, but modifies the geometry of the pistons and housings 22, 24 to allow the overall height of the actuator to be reduced. This is accomplished by allowing the pistons 18, 20 and housings 22, 24 to nest.

Specifically, in the closed position, the lower piston 18 nests closely with the lower housing 22. The upper piston 20 also nests with the upper housing 24. The inner surface or seal surface 57 of the upper housing 24 has sufficient height to accommodate the sliding seal between the upper housing and the upper stem 106 during full stroke of the pistons 18, 20. However, by defining the force transfer passage 58 with the axially extending flanges 50, 52, the bottom wall 48 of the lower extension 46 axially overlaps the seal surface 57. Thus, the bottom wall 48 can be positioned below the upward extending flange 50 (or radially outward from the passage 58). The upper piston 20, when in the closed position, receives the upward flange 50 within the second counterbore 92. Further, the upper piston 20 nests with the upper housing 24 such that the bottom surface 80 is closely positioned with or adjacent to the bottom wall 48. As a result, the nesting arrangement between the upper housing 24 and the upper piston 20 allows the actuator to have less axial height than prior known designs.

In the second or open position, the upper piston 20 is still positioned within the upper housing 24 and the lower piston 18 is still positioned within the lower housing 22. The upper housing 24, however, also nests with the lower piston 18 when the actuator 12 is in the second position. Specifically, the pocket or recessed portion 126 of the lower piston 18 receives the downward axially extending flange 52 of the upper housing 24. As a result, the outer portion 124 of the lower piston 18 axially overlaps the seal surface 57. Thus, the outer portion 124 can be positioned above the downward extending flange 52 (or radially outward from the passage 58). As a result, the nesting arrangement between the upper housing 24 and the lower piston 18 allow the actuator to have less axial height than prior known designs.

Figure 7:
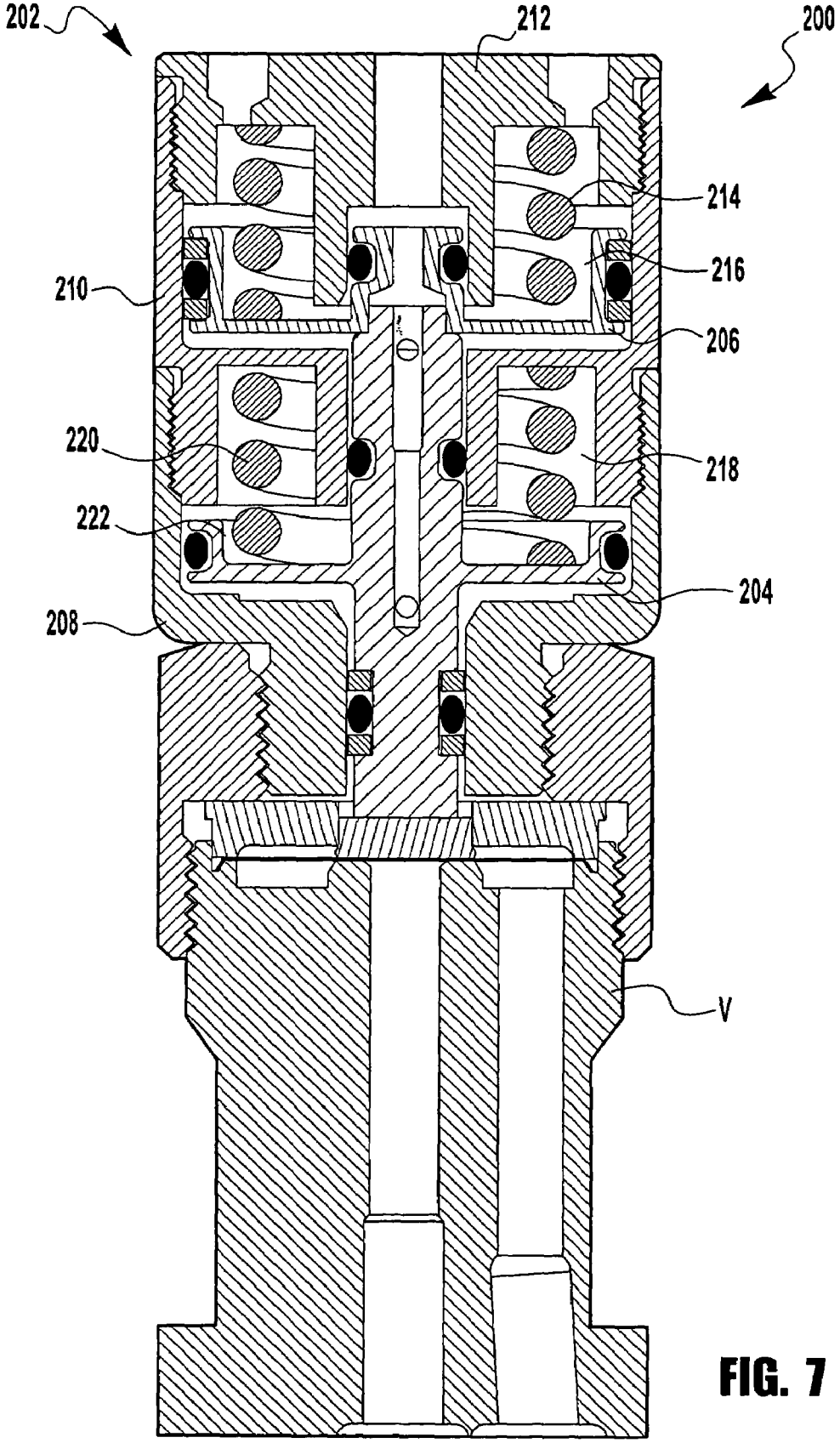
FIG. 7 is a cross-sectional view of another embodiment a valve body and a fluid actuator of the present invention shown in the closed position.
Figure 8:
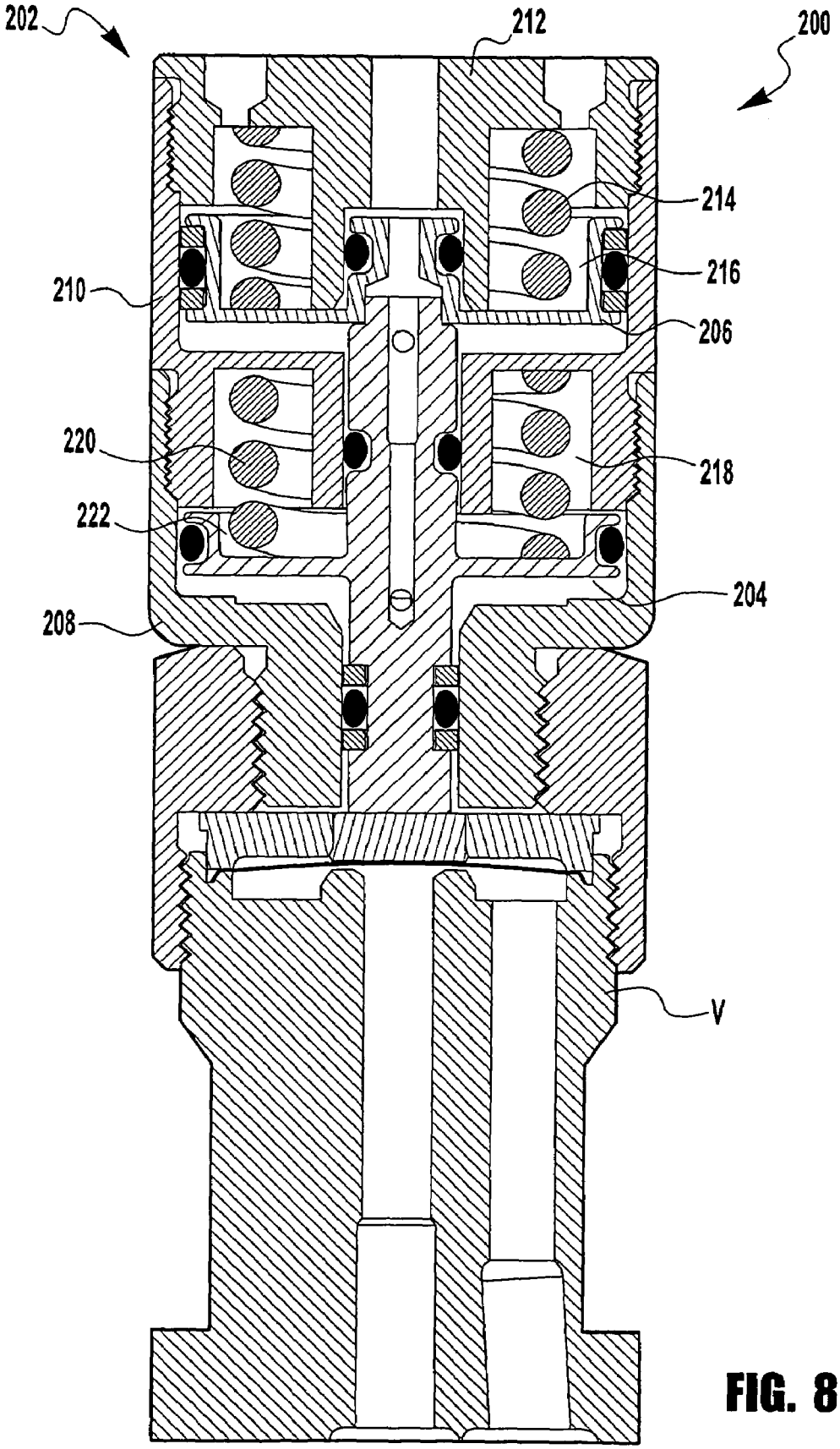
FIG. 8 is a cross-sectional view of the valve body and a fluid actuator of FIG. 7 shown in the open position.

FIGS. 7 and 8 illustrate another embodiment of a valve body and a fluid actuator of the present invention. In this embodiment, the actuator 200 has the same basic design and features as were described above for the actuator 12 of FIGS. 1-5. Namely, the actuator 200 includes a housing assembly 202, a lower piston 204, and an upper piston 206. The housing assembly 202 includes a lower housing 208, an upper housing 210, and a cap 212. A bias spring 214 may still be nested within a pocket 216 of the upper piston 206 and captured between the upper piston and cap 212.

In this example, however, the upper housing 210 is provided with a downward facing cup portion 218 adapted to capture a second biasing element 220, such as a spring for example, between the upper housing and the lower piston 204. The lower piston 204 includes a pocket 222 in which the spring 220 may nest. By using two smaller springs 214, 220, one for each piston 204, 206, the amount of biasing force on the upper piston can be reduced as compared to using a single larger spring. The bias force from the two springs 214, 220, however, combines to retain the same overall biasing force as would be present with the single larger spring.

Due to the presence of the second biasing element 220, some of the modifications of the upper housing 210 described for the embodiment of FIGS. 1-5 may be omitted. However, the pocketed pistons 204, 206 and the nested biasing elements 220, 214 still allow for significant reduction in the height of the actuator versus prior known designs.

The above description of some of the embodiments of the present invention has been given by way of example. From the disclosure given, those skilled in the art will not only understand the present invention and its attendant advantages, but will also find apparent various changes and modifications to the structures and methods disclosed. It is sought, therefore, to cover all such changes and modifications as fall within the spirit and scope of the invention, as defined by the appended claims, and equivalents thereof.

What is claimed is:

1. A fluid actuator for actuating a fluid component, comprising:

a housing assembly defining a first compartment;

a first movable actuator member disposed within the first compartment, the first movable actuator member comprising a radially extending fluid driven portion and a sidewall axially extending from an outer periphery of the fluid driven portion;

a second movable actuator member disposed in a second compartment;

a seal element disposed on the sidewall entirely above an axial midpoint of the sidewall, wherein the seal element provides a sliding seal between the movable actuator member and the housing assembly; and a biasing element acting between the housing assembly and the movable actuator member, at least a portion of the biasing element being nested with the movable actuator member;

wherein the housing assembly comprises a first housing component joined to a second housing component to form the second compartment.

2. The fluid actuator of claim 1 wherein a majority of the biasing element nests with the first movable actuator member.

3. The fluid actuator of claim 1 wherein the movable actuator member includes a pocket adapted to receive at least a portion of the biasing element.

4. The fluid actuator of claim 1 further comprising a second biasing element acting between the housing assembly and the second movable actuator member, at least a portion of the second biasing element nesting with the second movable actuator member.

5. The fluid actuator of claim 1 wherein the second movable actuator member has a pocket.

6. The fluid actuator of claim 5 wherein the pocket of the second movable actuator member is adapted to nest with the housing assembly.

7. The fluid actuator of claim 1 wherein the first and second movable actuator members are closely joined to move as a one-piece member.

8. A fluid actuator for actuating a fluid component, comprising:

a housing assembly comprising first and second compartments;

a first movable actuator member at least partially disposed within the first compartment of the housing assembly, the first movable actuator member comprising a radially extending fluid driven portion and a stem portion axially extending directly from the fluid driven portion and away from the second compartment; and a second movable actuator member at least partially disposed within the second compartment of the housing assembly, the second movable actuator member comprising a radially extending fluid driven portion and a stem portion axially extending directly from the fluid driven portion, wherein the stem portion of the second movable actuator member extends into the first compartment and beyond the fluid driven portion of the first movable actuator member.

9. The fluid actuator of claim 8 further comprising at least one seal element supported by one or more guidance mechanisms positioned on at least one of the first and second movable actuator members for preventing contact between the housing assembly and the at least one of the first and second movable actuator members.

10. The fluid actuator of claim 9 wherein the one or more guidance mechanisms comprise one or more guide rings.

11. The fluid actuator of claim 9 wherein the guidance mechanisms are made of PTFE.

12. The fluid actuator of claim 8 wherein the first movable actuator member is closely joined with the second movable actuator member such that the first movable actuator member and second movable actuator member move as a one piece member.

13. The fluid actuator of claim 8, wherein the stem portion of the first movable actuator member comprises a counterbore, and the stem portion of the second movable actuator extends into the counterbore.

14. A fluid actuator for actuating a fluid component, comprising:

a housing assembly comprising a first housing;

a first movable actuator member at least partially disposed within the first housing, the first movable actuator member comprising an axially extending stem portion, a radially extending fluid driven portion surrounding the stem portion, and an annular sidewall axially extending from the fluid driven portion and surrounding the stem portion;

a first seal element disposed between the stem portion and the housing assembly; and a second seal element disposed between the sidewall and the housing assembly, wherein the first and second seal elements provide a sliding seal between the first movable actuator member and the housing assembly.

15. The fluid actuator of 14 further comprising a biasing member that nests with the first movable actuator member between the stem portion and the sidewall.

16. The fluid actuator of 14 further comprising:

a second housing assembled to the first housing; and a second movable actuator member at least partially disposed within the second housing, the second movable actuator member movable between a first position and a second position.

17. The fluid actuator of claim 16 further comprising a guidance mechanism for selectively preventing contact between the second housing and the second movable actuator member.

18. The fluid actuator of claim 16 wherein the second housing includes a guidance portion, the guidance portion closely fitting within the first housing to keep the concentricity of the first and second housings close.

19. The fluid actuator of 14 further comprising a guidance mechanism for selectively preventing contact between the first housing and the first movable actuator member.

20. The fluid actuator of 14 further comprising a cap nested with the first housing, the cap including a guidance portion, the guidance portion closely fitting within the first housing to keep the concentricity of the cap and first housing close.

21. The fluid actuator of 14, wherein the housing assembly comprises a cap, and the first seal element is disposed between the stem portion and the cap to provide a sliding seal between the first movable actuator member and the cap.

22. A fluid actuator for actuating a fluid component, the fluid actuator positioned along an axis, comprising:

a first housing having an axially extending seal surface;

a first movable actuator member disposed within the first housing, the first movable actuator member movable between a first position and a second position;

a second housing assembled to the first housing; and a second movable actuator member disposed within the second housing, the second movable actuator member movable between a first position and a second position, wherein a portion of the first movable actuator member axially overlaps a portion of the seal surface when the first movable actuator member is in the first position, and wherein a portion of the second movable actuator member axially overlaps a portion of the seal surface when the second movable actuator member is in the second position.

23. A fluid actuator for actuating a fluid component, the fluid actuator positioned along an axis, comprising:

a first housing having an axially extending seal surface;

a first movable actuator member disposed within the first housing, the first movable actuator member movable between a first position and a second position;

a second housing assembled to the first housing; and a second movable actuator member disposed within the second housing, the second movable actuator member movable between a first position and a second position, wherein a portion of the first movable actuator member axially overlaps a portion of the seal surface when the first movable actuator member is in the first position, and wherein the second movable actuator member nests with the first housing when the second movable actuator member is in the second position.

24. A movable actuator member for a fluid actuator, comprising:

a radially extending fluid driven portion;

a stem portion axially extending directly from the fluid driven portion and surrounded by the fluid driven portion; and an annular sidewall axially extending from an outer periphery of the fluid driven portion, the sidewall including an annular seal groove for receiving a seal element, the groove being disposed entirely above an axial midpoint of the sidewall;

wherein the stem portion includes a counterbore for receiving a portion of a second movable actuator member.

25. The movable actuator member of claim 24, wherein an upper portion of the stem portion includes an annular seal groove for receiving a seal element.

26. The movable actuator member of 24, wherein the annular seal groove is defined by first and second flanges extending radially from the upper portion.

* * * * *

UNITED STATES PATENT AND TRADEMARK OFFICE

CERTIFICATE OF CORRECTION

PATENT NO. : 7,252,032 B2
APPLICATION NO. : 11/143411
DATED : August 7, 2007
INVENTOR(S) : Gary Scheffel et al.

It is certified that error appears in the above-identified patent and that said Letters Patent is hereby corrected as shown below:

Column 6, line 65, “intennediate” should read --intermediate--.

Signed and Sealed this

Eighth Day of July, 2008

JON W. DUDAS
*Director of the United States Patent and Trademark Office*